US009433037B2

(12) United States Patent
Isoda et al.

(10) Patent No.: US 9,433,037 B2
(45) Date of Patent: Aug. 30, 2016

(54) INDUCTION HEATING COOKER

(71) Applicant: Panasonic Corporation, Kadoma-shi, Osaka (JP)

(72) Inventors: Keiko Isoda, Kyoto (JP); Yuji Fujii, Hyogo (JP); Daisuke Sawada, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 466 days.

(21) Appl. No.: 14/002,495

(22) PCT Filed: Nov. 7, 2012

(86) PCT No.: PCT/JP2012/007135
§ 371 (c)(1),
(2) Date: Aug. 30, 2013

(87) PCT Pub. No.: WO2013/099085
PCT Pub. Date: Jul. 4, 2013

(65) Prior Publication Data

US 2013/0334213 A1 Dec. 19, 2013

(30) Foreign Application Priority Data

Dec. 28, 2011 (JP) ..... 2011-288457

(51) Int. Cl.
*H05B 6/06* (2006.01)
*H05B 6/04* (2006.01)
*H05B 6/08* (2006.01)

(52) U.S. Cl.
CPC ..... *H05B 6/065* (2013.01); *H05B 6/08* (2013.01)

(58) Field of Classification Search
CPC ..... H05B 6/065; H05B 6/06; H05B 6/04; H05B 6/08; H05B 6/101; H05B 6/40
USPC ..... 219/620, 624, 632, 660, 661, 662, 664, 219/665
See application file for complete search history.

(56) References Cited

U.S. PATENT DOCUMENTS

2011/0163086 A1 7/2011 Aldana Arjol et al.
2012/0152935 A1 6/2012 Kitaizumi et al.
2014/0151365 A1* 6/2014 Oh ..... H05B 6/065 219/620

FOREIGN PATENT DOCUMENTS

CN 1104750 A 7/1995
CN 1816226 A 8/2006
(Continued)

OTHER PUBLICATIONS

Extended European Search Report in corresponding European Application No. 12861943.4, dated Jun. 3, 2015, 4 pages.
International Search Report for International Application No. PCT/JP2012/007135, dated Dec. 4, 2012, 1 page.
(Continued)

*Primary Examiner* — Quang Van
(74) *Attorney, Agent, or Firm* — Brinks Gilson & Lione

(57) ABSTRACT

A conventional induction heating cooker which operates two inverters at the same time, with only one input current detecting circuit provided, cannot measure each of input currents to each of the plurality of inverters, and cannot control input powers by feedback control on input currents. In the induction heating cooker which has a plurality of inverters, when the input power varies to the inverter which has less input power supplied, the variation hardly influences the cooking. The induction heating cooker according to the present invention fixes the operating frequency for the inverter which has less input power supplied and performs the feedback control of the input current for the inverter which has bigger input power supplied.

2 Claims, 6 Drawing Sheets

(56) References Cited

FOREIGN PATENT DOCUMENTS

| | | | |
|---|---|---|---|
| JP | 7-57867 | A | 3/1995 |
| JP | 2010-212052 | A | 9/2010 |
| JP | 2011-150797 | A | 8/2011 |
| WO | WO 2011/089900 | A1 | 7/2011 |

OTHER PUBLICATIONS

Office Action and Search Report, and partial English language translation thereof, in corresponding Chinese Application No. 201280011097.5, dated Nov. 21, 2014, 9 pages.

Translation of International Search Report on Patentability for corresponding PCT application No. PCT/JP2012/007135, dated Jul. 10, 2014, 6 pages.

* cited by examiner

CONDUCTION RATIO (%) = (CONDUCTION TIME OF SEMICONDUCTOR SWITCH)/(CYCLE) × 100

INDUCTION HEATING COOKER

This application is a 371 application of PCT/JP2012/007135 having an international filing date of Nov. 7, 2012, which claims priority to JP2011-288457 filed Dec. 28, 2011, the entire contents of which are incorporated herein by reference.

TECHNICAL FIELD

The present invention relates to an induction heating cooker which operates a plurality of inverters at the same time.

BACKGROUND ART

A conventional induction heating cooker which operates a plurality of inverters at the same time is, for example, the induction heating cooker disclosed in Patent Document 1.

FIG. 7 is a diagram illustrating circuitry of the induction heating cooker described in Patent Document 1, and FIG. 8 is a chart of actuating signals of inverters in the induction heating cooker.

As illustrated in FIG. 7, the induction cooker described in Patent Document 1 includes: an AC power supply 101; first and second heating coils 102 and 103; a rectifier circuit 104 which rectifies the AC power supply 101; a smoothing capacitor 105 which smoothes a voltage of the rectifier circuit 104; first and second heating coils 102 and 103; first and second inverters 106 and 107 which convert outputs from the smoothing capacitor 105 into high-frequency powers and supplies the high-frequency powers to the first and second heating coils 102 and 103; an input current detection unit 108 which detects an input current from the AC power supply 101, and a control unit 109 which has a microcomputer for controlling operating states of semiconductor switches in the first and second inverters 106 and 107 to cause the detected value by the input current detection unit 108 to be a set value.

In the induction heating cooker 100 illustrated in FIG. 7, the control unit 109 controls the conduction times of the semiconductor switches in the first and second inverters 106 and 107 to cause the input current from the AC power supply 101 detected by the input current detection unit 108 to be a previously set current value. As a result, required high-frequency currents are supplied to the first and second heating coils 102 and 103 which are connected to the first and second inverters 106 and 107.

High-frequency magnetic fields are induced by the high-frequency currents in the first and second heating coils 102 and 103, and the high-frequency magnetic fields are applied to a load such as a pot which is magnetically coupled to the heating coil. The applied high-frequency magnetic fields induce an eddy current in the load such as a pot, and the pot is heated by the surface resistance of its own and the eddy current.

In the case where the first and second heating coils 102 and 103 heat the pot at the same time, the first inverter 106 has the conduction time of the semiconductor switch controlled to cause the input power to the first heating coil 102 to be P1 in an operation mode 1, as illustrated in FIG. 8. Further, the first inverter 106 has the conduction time of the semiconductor switch controlled to cause the input power to the first heating coil 102 to be P3 in an operation mode 2.

The second inverter 107 has the conduction time of the semiconductor switch controlled to cause the input power to the second heating coil 103 to be P2 in the operation mode 1. Further, the second inverter 107 has the conduction time of the semiconductor switch controlled to cause the input power to the second heating coil 103 to be P4 in the operation mode 2.

The operation mode 1 and the operation mode 2 are repeated to the first and second inverters 106 and 107 to cause the first and second heating coils 102 and 103 to alternately heat the pot with different input powers.

Patent Document 1: JP 2011-150797 A

SUMMARY OF THE INVENTION

Problems to be Solved by the Invention

However, in the above described conventional induction heating cooker, the current value detected by the input current detection unit is the sum of the input current to the first heating coil and the input current to the second heating coil. Therefore, the control unit cannot be informed of how much the input current to the first heating coil accounts for the detected current value. Then, the control unit sometimes fails to sufficiently control the conduction time of the semiconductor switch to cause the input currents to the first and/or second heating coils to be a previously set current value. As described above, since it is difficult for the conventional induction heating cooker to give correct feedback of the input current value and, accordingly, the input power of the cooker varies when it is used, users of the cooker cannot enjoy cooking comfortably.

The present invention is intended to solve the above described conventional problem, and it is an object of the invention to provide an induction heating cooker which is configured to heat with a plurality of heating coils at the same time and yet has the input powers less varied and, accordingly, allows the users to enjoy cooking comfortably.

Means for Solving the Problem

The present invention is made for the purpose of solving the above problem. An induction heating cooker according to the embodiment of the present invention includes:

- a rectifier circuit which rectifies an AC power supply;
- an input current detecting circuit which detects a current flowing from the AC power supply to the rectifier circuit;
- a smoothing capacitor which smoothes an output from the rectifier circuit;
- a first heating coil;
- a second heating coil;
- a first inverter which converts an output from the smoothing capacitor into a predetermined frequency by using a semiconductor switch to supply a high-frequency power to the first heating coil;
- a second inverter which converts the output from the smoothing capacitor into a predetermined frequency by using a semiconductor switch to supply a high-frequency power to the second heating coil; and
- a control unit which controls operation of the semiconductor switch to cause the current detected by the input current detecting circuit to be a previously set current value, wherein in the case where the first and second inverters are operated at the same time, the control unit controls to alternately repeat

- a first operation mode in which an output power from the first inverter is a first output power and an output power from the second inverter is a second output power which is lower than the first output power and a second operation mode in which an output power from the first inverter is a third output power which is lower than the first output power and an output power from the second inverter is a fourth output power which is higher than the second output power and also higher than the third output power, and in the first operation mode, the control unit maintains an operating frequency of the second inverter constant and controls an operating frequency of the first inverter by controlling a conduction time of the semiconductor switch to cause the current detected by the input current detecting circuit to be the previously set current value, and in the second operation mode, the control unit maintains the operating frequency of the first inverter constant and controls the operating frequency of the second inverter by controlling a conduction time of the semiconductor switch to cause the current detected by the input current detecting circuit to be the previously set current value.

Effects of the Invention

In the induction heating cooker according to the present invention, a plurality of inverters increase and decrease the input powers to the heating coils, respectively, based on the feedback control of the current values. The induction heating cooker according to the present invention is provided with, for example, no more than one input current detecting circuit for detecting the input currents. Even with only one input current detecting circuit for detecting the input currents, when the power is supplied to the two heating coils at the same time, the induction heating cooker according to the present invention maintains the operating frequency of one of the heating coils constant, thus, the input current constant, so that the cooker can correctly detect the current value of the other heating coil. As a result, the feedback control is correctly performed on the current values.

In the induction heating cooker which has a plurality of inverters, when the input power varies to the inverter which has less input power supplied, the variation hardly influences the cooking. The induction heating cooker according to the present invention fixes the operating frequency for the inverter which has less input power supplied and performs the feedback control of the input current for the inverter which has more input power supplied. As a result, since the variation of the input power is reduced and the constant input powers can be used for cooking, the user can enjoy cooking comfortably.

DETAILED DESCRIPTION OF THE PREFERRED EMBODIMENTS

Figure 1:
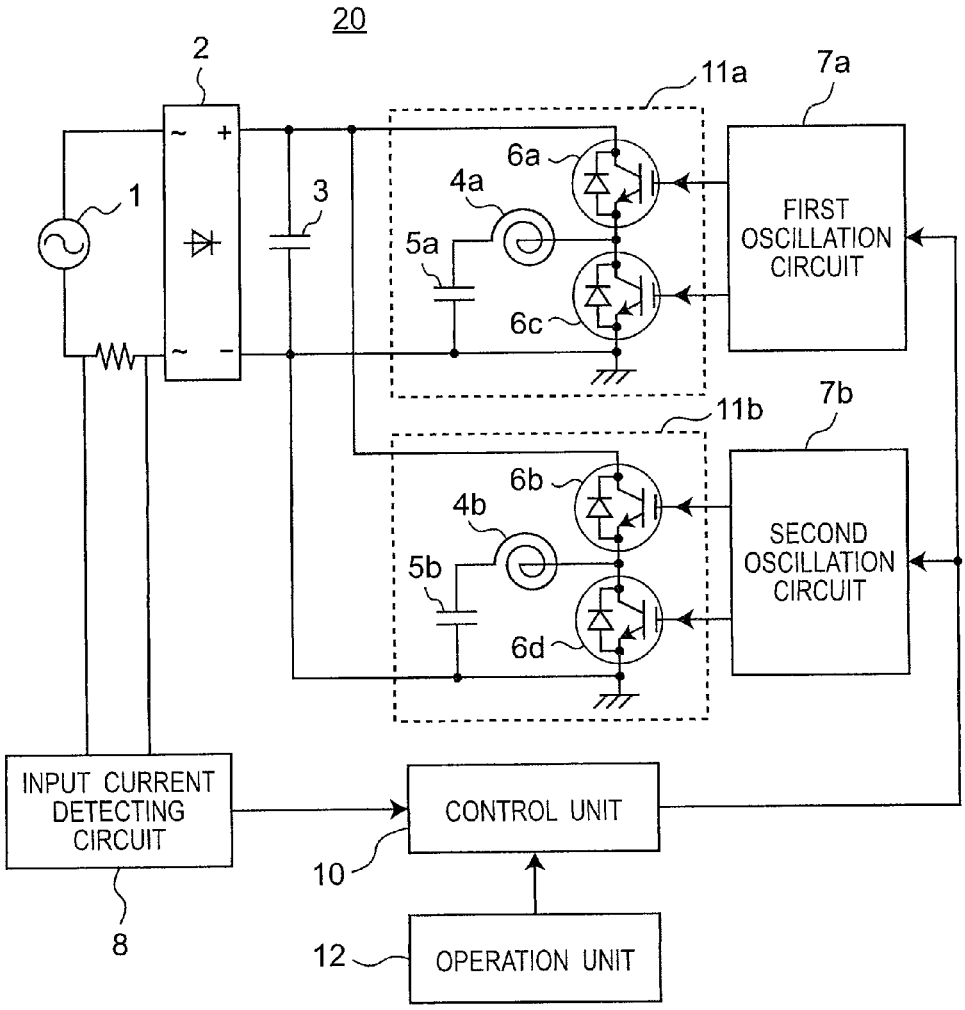
FIG. 1 is a diagram illustrating circuitry of an induction heating cooker according to a first embodiment of the present invention.

An induction heating cooker according to a first invention includes: a rectifier circuit which rectifies an AC power supply; an input current detecting circuit which detects a current flowing from the AC power supply to the rectifier circuit; a smoothing capacitor which smoothes an output from the rectifier circuit; a first heating coil; a second heating coil; a first inverter which converts an output from the smoothing capacitor into a predetermined frequency by using a semiconductor switch to supply a high-frequency power to the first heating coil; a second inverter which converts the output from the smoothing capacitor into a predetermined frequency by using a semiconductor switch to supply a high-frequency power to the second heating coil; and a control unit which controls operation of the semiconductor switch to cause the current detected by the input current detecting circuit to be a previously set current value.

In the case where the first and second inverters are operated at the same time, the control unit controls to alternately repeat a first operation mode in which an output power from the first inverter becomes a first output power and an output power from the second inverter becomes a second output power which is lower than the first output power and a second operation mode in which an output power from the first inverter becomes a third output power which is lower than the first output power and an output power from the second inverter becomes a fourth output power which is higher than the second output power and also higher than the third output power.

Further, in the first operation mode, the control unit maintains an operating frequency of the second inverter constant and controls an operating frequency of the first inverter by controlling a conduction time of the semiconductor switch to cause the current detected by the input current detecting circuit to be the previously set current value, and in the second operation mode, the control unit maintains the operating frequency of the first inverter constant and controls the operating frequency of the second inverter by controlling a conduction time of the semiconductor switch to cause the current detected by the input current detecting circuit to be the previously set current value.

In the induction heating cooker according to the first invention, the input current detecting circuit detects a current value which is the sum of the input currents to the first and second heating coils. When the input current to the second heating coil is maintained constant, the result of subtracting the input current value of the second heating coil from the current value detected by the input current detecting circuit is the input current value of the first heating coil. The control unit uses the value for the feedback control to control the operating frequency of the first heating coil.

That is, in the induction heating cooker according to the present invention which has two inverters for controlling the input powers to the heating coils by performing feedback control of the input currents, when the currents are supplied to the two heating coils for the respective two inverters at the same time, the feedback control is not performed for the heating coil which has the lower input power supplied, since the input power to the heating coil varies little. On the other hand, the feedback control is performed for the heating coil which has the higher input power supplied, since the input power to the heating coil varies large because of a variation of resonance frequency with a pot as a load. As a result, the input power is controlled to be a predetermined input power.

As described above, even with no more than one input power detecting circuit, the induction heating cooker which has a plurality of inverters and heating coils corresponding to the respective inverters can supply a stable input power to the plurality of heating coils to realize stable heating.

Embodiments of the present invention will be described below with reference to the drawings. The embodiments below are merely examples and are not intended to limit the present invention.

First Embodiment

FIG. 1 is a diagram illustrating circuitry of an induction heating cooker according to the first embodiment of the present invention.

(1.1 Configuration of the Induction Heating Cooker)

An induction heating cooker 20 according to the first embodiment illustrated in FIG. 1 includes an AC power supply 1, a rectifier circuit 2 which rectifies the AC power supply 1, and a smoothing capacitor 3 which smoothes an output from the rectifier circuit 2. The induction heating cooker 20 according to the first embodiment further includes a first inverter 11*a* and a second inverter 11*b* which convert outputs from the smoothing capacitor 3 into high-frequency powers, and a first heating coil 4*a* and a second heating coil 4*b* which are connected to the respective inverters and have the high-frequency currents supplied from the respective inverters. Further, the induction heating cooker 20 according to the first embodiment includes an input current detecting circuit 8 which detects a current flowing from the AC power supply 1 to the rectifier circuit 2 by such means as a current transformer, and a control unit 10 which controls semiconductor switches in the first and second inverters to cause the detected value by the input current detecting circuit 8 to be a set value which is set by an operation unit 12 (described later).

The first inverter 11*a* includes a first resonant capacitor 5*a*, and first switching elements 6*a* and 6*c*. The first inverter 11*a* including these components is for converting the DC power supply to AC and is connected with the smoothing capacitor 3 in parallel. Similarly, the second inverter 11*b* includes a second resonant capacitor 5*b*, and second switching elements 6*b* and 6*d*. The second inverter 11*b* including these components is for converting the DC power supply to AC and is connected with the smoothing capacitor 3 in parallel.

A first oscillation circuit 7*a* drives the first switching elements 6*a* and 6*c* in the first inverter 11*a*. Similarly, a second oscillation circuit 7*b* drives the second switching elements 6*b* and 6*d* in the second inverter 11*b*.

A user of the induction heating cooker 20 performs such operations as to select heating of an object to be heated (not shown) or to adjust power, by using the operation unit 12. The control unit 10 has a microcomputer and controls the first and second inverters 11*a* and 11*b* via the first and second oscillation circuits 7*a* and 7*b* by inputting values detected by the input current detecting circuit 8 to cause such values to be the heating set values selected by the operation unit 12.

(1.2 Operation of the Induction Heating Cooker)

Figure 2:
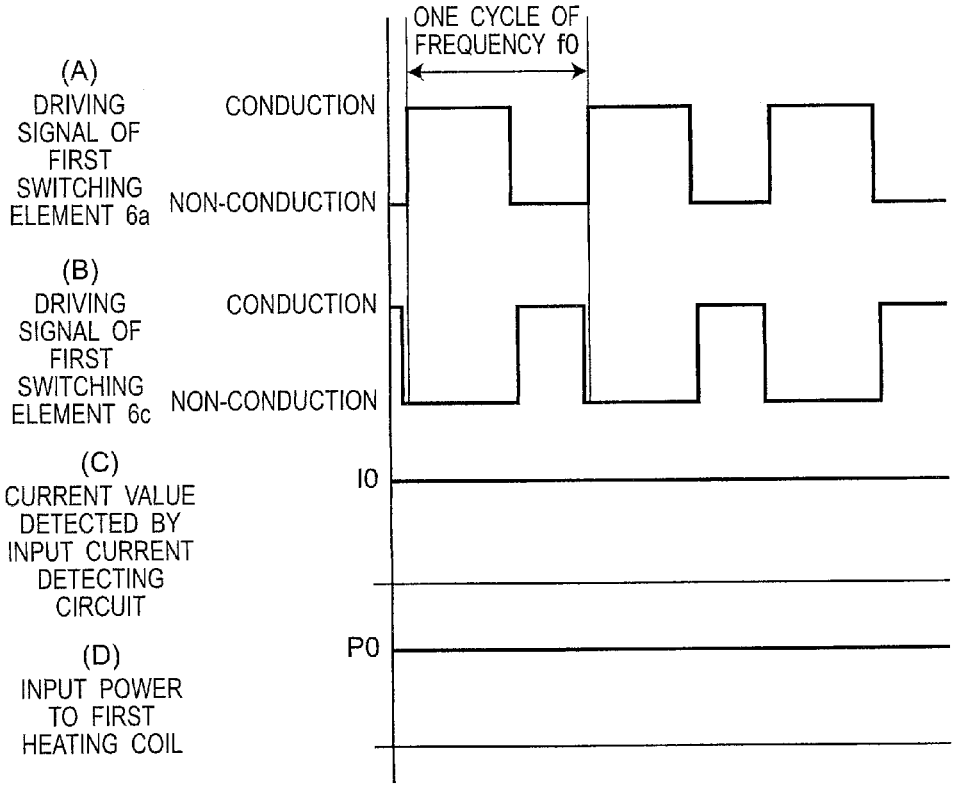
FIG. 2(A)-(D) are charts of actuating signals of an inverter which is solely heating in the induction heating cooker according to the first embodiment of the present invention.

FIG. 2 is a chart of actuating signals of an inverter which is solely heating in the induction heating cooker 20 according to the first embodiment of the present invention and, particularly, is a diagram showing operation timings of the inverter in the case where the inverter solely operates the first heating coil 4*a*.

In FIG. 2, FIG. 2(A) represents a driving signal of the first switching element 6*a*, and FIG. 2(B) represents a driving signal of the first switching element 6*c*, respectively. FIG. 2(C) represents the current value detected by the input current detecting circuit 8. Further, FIG. 2(D) represents the input power to the first heating coil 4*a*.

For the first inverter 11 a which uses a series resonant circuit between the first heating coil 4*a* and the first resonant capacitor 5*a*, the control unit 10 controls the first oscillation circuit 7*a* to cause the input current to be a predetermined value by changing the operating frequency with respect to the resonance frequency to obtain a desired input power, wherein the resonance frequency is decided based on an inductance of the first heating coil 4*a* on which a pot is placed and the capacity of the first resonant capacitor 5*a*. As the operating frequency is closer to the resonance frequency, the higher input power can be obtained.

For example, on the condition that the resonance frequency of the first heating coil 4*a* and the pot is 20 kHz, when the first switching elements 6*a* and 6*c* operate at 20 kHz, the input current becomes I0 and the maximum value P0 can be obtained as the input power.

When the user of the induction heating cooker 20 replaces the pot placed on the first heating coil 4*a* by another pot and specifies the input power of the first heating coil 4*a* to "P0" via the operation unit 12, feedback of the current value detected by the input current detecting circuit 8 is given to the control unit 10. The control unit 10 changes the operating frequency to cause the detected current value to be the predetermined value I0 via the first oscillation circuit 7*a*. That is, the control unit 10 performs a feedback control to operate the first oscillation circuit 7*a* at the operating frequency f0 which causes the current value to be I0.

A high-frequency current induces a high-frequency magnetic field in the first heating coil 4*a*. The high-frequency magnetic field is applied to an object to be heated such as a pot which is magnetically coupled to the first heating coil 4*a*. The high-frequency magnetic field induces an eddy current in the object to be heated such as a pot, and the pot is heated by the surface resistance of its own and the eddy current.

The second inverter 11*b* also operates in the same way as the first inverter 11*a*.

Figure 3:
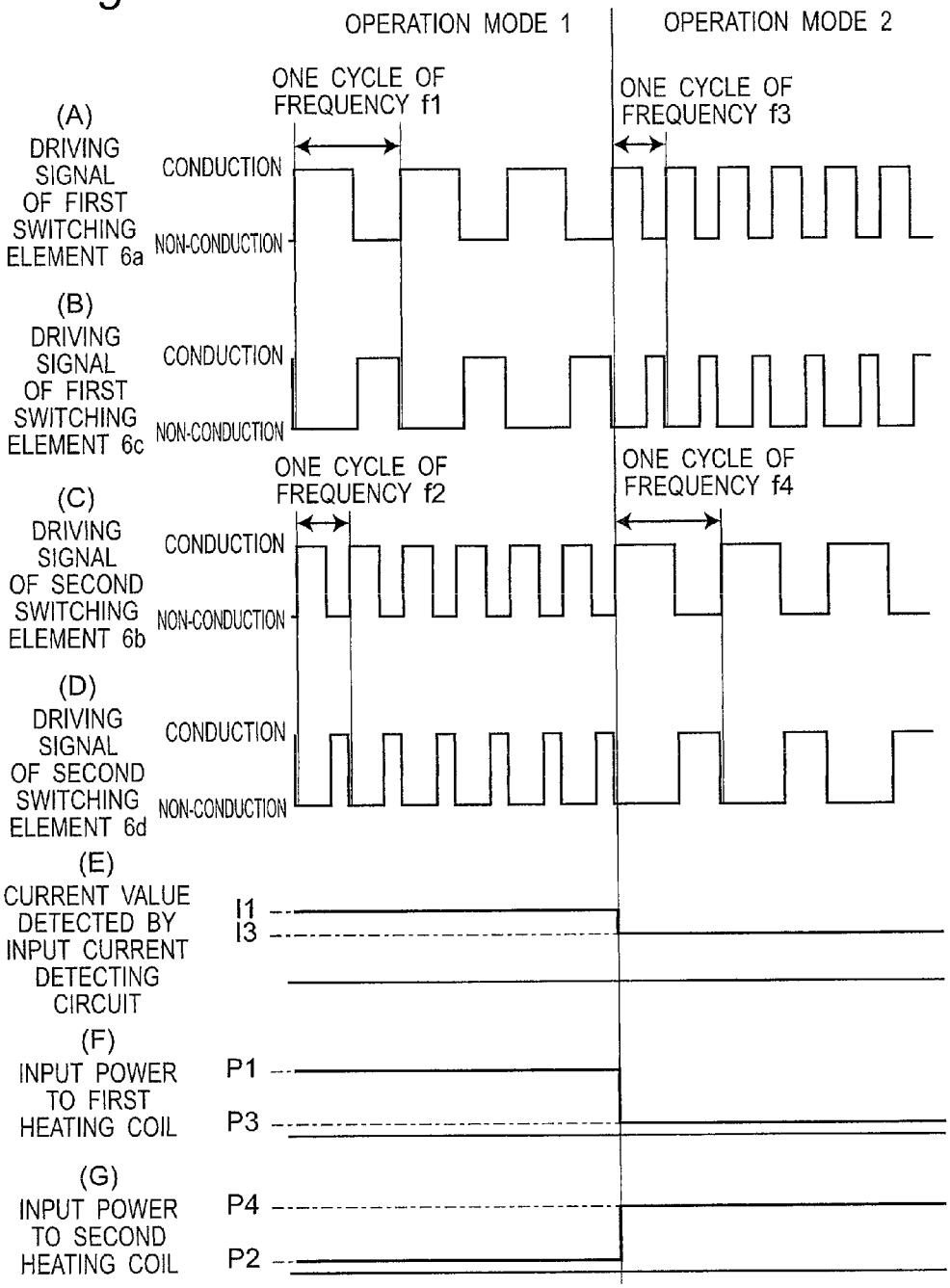
FIG. 3(A)-3(G) are charts of actuating signals of inverters which are alternately heating in the induction heating cooker according to the first embodiment of the present invention.

FIG. 3 is a chart of actuating signals of inverters which are alternately heating in the induction heating cooker 20 according to the first embodiment of the present invention and, particularly, is a diagram showing operation timings of the inverters in the case where the first heating coil 4*a* and the second heating coil 4*b* are operated at the same time.

In FIG. 3, FIG. 3(A) represents a driving signal of the first switching element 6*a*, and FIG. 3(B) represents a driving signal of the first switching element 6*c*, respectively. FIG.

3(C) represents a driving signal of the second switching element 6*b*, and FIG. 3(D) represents a driving signal of the second switching element 6*d*, respectively. FIG. 3(E) represents the current value detected by the input current detecting circuit 8. Further, FIG. 3(F) represents the input power to the first heating coil 4*a*, and FIG. 3(G) represents the input power to the second heating coil 4*b*, respectively.

When the user of the induction heating cooker 20 instructs the cooker 20 via the operation unit 12 such that the first heating coil 4*a* with the input power Pa will realize heating-operation and the second heating coil 4*b* with the input power Pb will realize heating-operation, the control unit 10 controls the first and second oscillation circuits 7*a* and 7*b* to drive the first switching elements 6*a* and 6*c* and the second switching elements 6*b* and 6*d* for the first and second inverters 11*a* and 11*b*, respectively.

That is, under the control of the control unit 10, in the operation mode 1, the first switching elements 6*a* and 6*c* operate at the operating frequency f1 which causes the input power of the first heating coil 4*a* to be P1, and the second switching elements 6*b* and 6*d* operate at the operating frequency f2 which causes the input power of the second heating coil 4*b* to be P2.

Further, under the control of the control unit 10, in the operation mode 2, the first switching elements 6*a* and 6*c* operate at the operating frequency f3 which causes the input power of the first heating coil 4*a* to be P3, and the second switching elements 6*b* and 6*d* operate at the operating frequency f4 which causes the input power of the second heating coil 4*b* to be P4.

It is assumed that the operation mode 1 has an operating time T1 and the operation mode 2 has an operating time T2. On the condition that the operation mode 1 of the operating time T1 and the operation mode 2 of the operating time T2 are alternately repeated, the input power Pa of the first heating coil 4*a* is $$Pa=P1\times T1/(T1+T2)+P3\times T2/(T1+T2).$$

The input power Pb of the second heating coil 4*b* is $$Pb=P2\times T1/(T1+T2)+P4\times T2/(T1+T2).$$

For example, the input powers such as Pa=800 W, Pb=500 W, T1=10 ms, and T2=10 ms are realized by a combination of P1=1200 W, P2=400 W, P3=400 W, and P4=600 W.

Usually, the control unit 10 operates the first and second oscillation circuits 7*a* and 7*b* to cause the input current to be a predetermined value by changing the operating frequency. That is, in the operation mode 1, the control unit 10 usually controls to cause the input current to be I1 and the input power to be P1 for the first heating coil 4*a* by changing the operating frequency. Also for the second heating coil 4*b*, the control unit 10 usually controls to cause the input current to be I2 and the input power to be P2 by changing the operating frequency.

However, the input current detecting circuit 8 is for detecting the sum of the currents input to the respective coils, and cannot detect the input current to the individual coil. Then, the induction heating cooker 20 according to the first embodiment fixes the operating frequency of the second heating coil 4*b*, which has the lower input power, to f2 and assumes the input current to be I2. For the first heating coil 4*a*, the control unit 10 changes the operating frequency by the feedback control via the second oscillation circuit 7*b* to cause the current value detected by the input current detecting circuit 8 to be (I1+I2).

In that case, the input power to the second heating coil 4*b* is deviated from a desired input power since the feedback control is not performed for that input power, but the input power is so small that the deviation is negligible. Since the input power value is big for the input power to the first heating coil 4*a*, the control unit 10 performs the feedback control on the input current to correctly obtain the desired input power P1.

In the operation mode 2, usually the control unit 10 controls to cause the input current to be I3 and the input power to be P3 for the first heating coil 4*a* by changing the operating frequency. Also for the second heating coil 4*b*, usually the control unit 10 controls to cause the input current to be I4 and the input power to be P4 by changing the operating frequency. However, due to the above described reason, the induction heating cooker 20 according to the first embodiment does not perform such a control.

That is, in the operation mode 2, the induction heating cooker 20 according to the first embodiment fixes the operating frequency of the first heating coil 4*a*, which has the lower input power, to f3 and assumes the input current to be I3. For the second heating coil 4*b*, the control unit 10 changes the operating frequency by the feedback control via the first oscillation circuit 7*a* to cause the current detected by the input current detecting circuit 8 to be (I3+I4). In that case, the input power to the first heating coil 4*a* is deviated from a desired input power since the feedback control is not performed for that input power, but the input power is so small that the deviation is negligible. Since the input power value is big for the input power to the second heating coil 4*b*, the control unit 10 performs the feedback control on the input current to correctly obtain the desired input power P4.

(1.3. Summarization)

As described above, the induction heating cooker 20 according to the first embodiment heats the pot by repeating the operation mode 1 and the operation mode 2 in the alternating operation of the first heating coil 4*a* and the second heating coil 4*b* to obtain the desired input powers for the respective coils by the feedback control on the input currents. Even with only one input current detecting circuit 8, the induction heating cooker 20 according to the first embodiment, which performs the heating operation by alternating a plurality of heating coils, can control the input power to each of the coils. As a result, the manufacturing cost can be reduced for the input current detecting circuit 8.

Second Embodiment

Now, an induction heating cooker according to the second embodiment of the present invention will be described. First, the induction heating cooker according to the second embodiment has the same circuitry as that of the induction heating cooker according to the first embodiment illustrated in FIG. 1. The induction heating cooker according to the second embodiment is different from the induction heating cooker according to the first embodiment in the contents of control performed by the control unit 10. The embodiment will be described below around the difference in the contents of control performed by the control unit 10.

Figure 4:
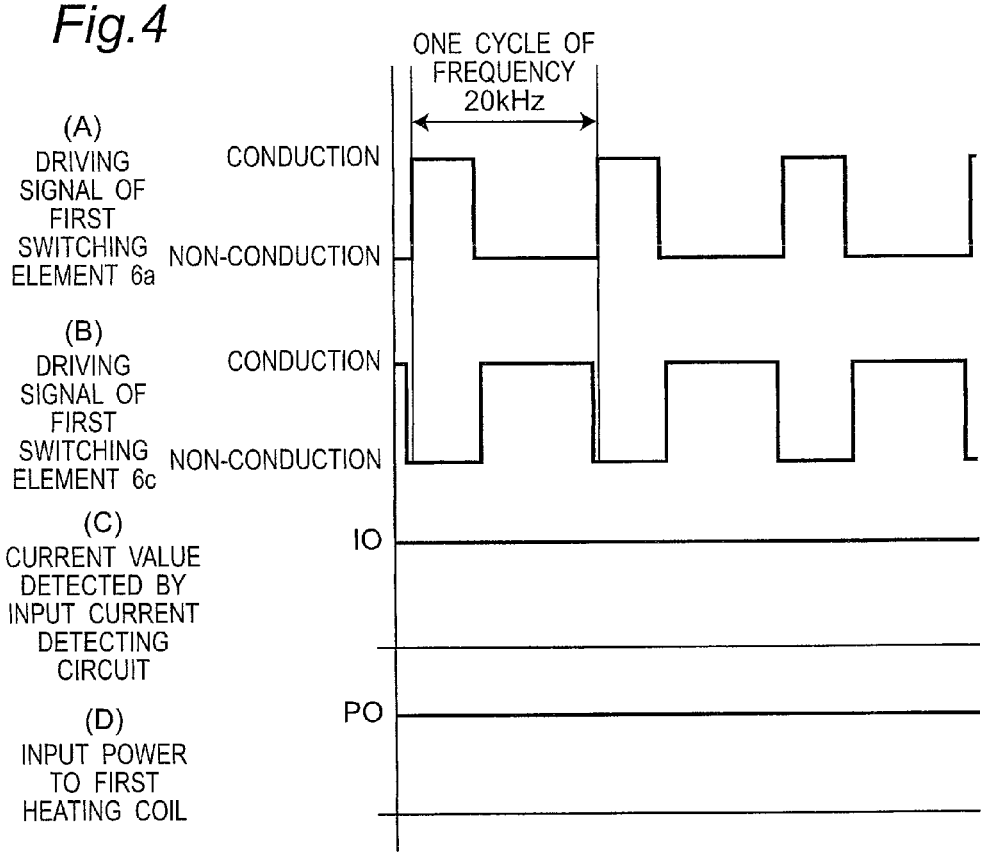
FIG. 4 is a chart of actuating signals of an inverter which is solely heating in an induction heating cooker according to a second embodiment of the present invention.

FIG. 4 is a chart of actuating signals of an inverter which is solely heating in the induction heating cooker 20 according to the second embodiment of the present invention and, particularly, is a diagram showing operation timings of the inverter in the case where the inverter solely operates the first heating coil 4*a*.

In FIG. 4, FIG. 4(A) represents a driving signal of the first switching element 6*a*, and FIG. 4(B) represents a driving signal of the first switching element 6*c*, respectively. FIG. 4(C) represents the current value detected by the input current detecting circuit 8. Further, FIG. 4(D) represents the input power to the first heating coil 4*a*.

For the first inverter 11*a* which uses a series resonant circuit between the first heating coil 4*a* and the first resonant capacitor 5*a* in the induction heating cooker 20 according to the second embodiment, the control unit 10 fixes the operating frequency and changes the conduction ratios of the first switching elements 6*a* and 6*b* to obtain a desired input power.

Figure 5:
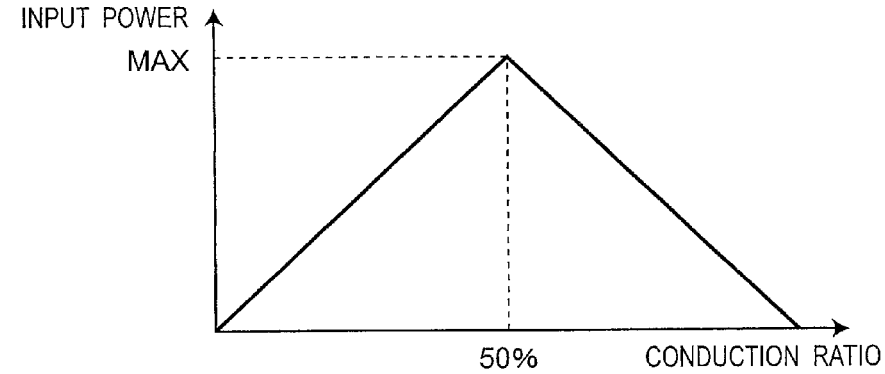
FIG. 5 is a performance map of the induction heating cooker according to the second embodiment of the present invention for a conduction ratio of a switching element and an input power.

FIG. 5 is a performance map of the induction heating cooker 20 according to the second embodiment for the conduction ratio of a switching element and the input power and, particularly, shows variation in the input power to the first heating coil 4*a* in the case where the conduction ratio of the first switching element 6*a* is changed.

As shown in FIG. 5, the input power to the first heating coil 4*a* becomes the maximum when the conduction ratio of the first switching element 6*a* is 50%. Performances for the conduction ratios of the other switching elements (6*c*, 6*b*, and 6*d*) and the input powers are the same as that of the first switching element 6*a*.

In the induction heating cooker 20 according to the second embodiment, the first resonant capacitor 5*a* is designed to cause the resonance frequency of the first heating coil 4*a* and the pot becomes around 20 kHz, for example. In the induction heating cooker 20 with the above described design, the control unit 10 controls the conduction ratios of the first switching elements 6*a* and 6*c* to cause the input current to be I0 and to obtain the maximum power P0 while operating the first switching elements 6*a* and 6*c* at a fixed frequency of 20 kHz.

Feedback of the input current detected by the input current detecting circuit 8 is given to the control unit 10, and the control unit 10 changes the conduction ratios to cause the detected current to be the predetermined value I0. That is, the control unit 10 operates the first oscillation circuit 7*a* at the conduction ratio of X1 which causes the current value to be I0 by using the feedback control.

The second inverter 11*b* also operates in the same way as the first inverter 11*a*.

As described above and as illustrated in FIGS. 4 and 5, the induction heating cooker 20 of this embodiment can provide the same effect as that provided by a cooker changing the operating frequency as described in the first embodiment, also in the case where the cooker 20 changes the input powers to the first and second inverters 11*a* and 11*b* by changing the conduction ratios while operating the switching elements at a fixed frequency.

Therefore, in the case where the material or the shape of the pot may change or the power set value may be changed, the input power can be also correctly controlled in the induction heating cooker by fixing the operating frequency of the first inverter 11*a* or the second inverter 11*b*. Further, compared with the case of the induction heating cooker according to the first embodiment which changes the operating frequency, the induction heating cooker of this embodiment may simplify the controlling method of the operating frequencies which are respectively decided for the first and second inverters 11*a* and 11*b*. Further, the induction heating cooker of this embodiment can reduce the inverter loss by preventing the switching elements of the first and second inverters 11*a* and 11*b* from being operated at high operating frequencies in the operation mode 1 and the operation mode 2.

Figure 6:
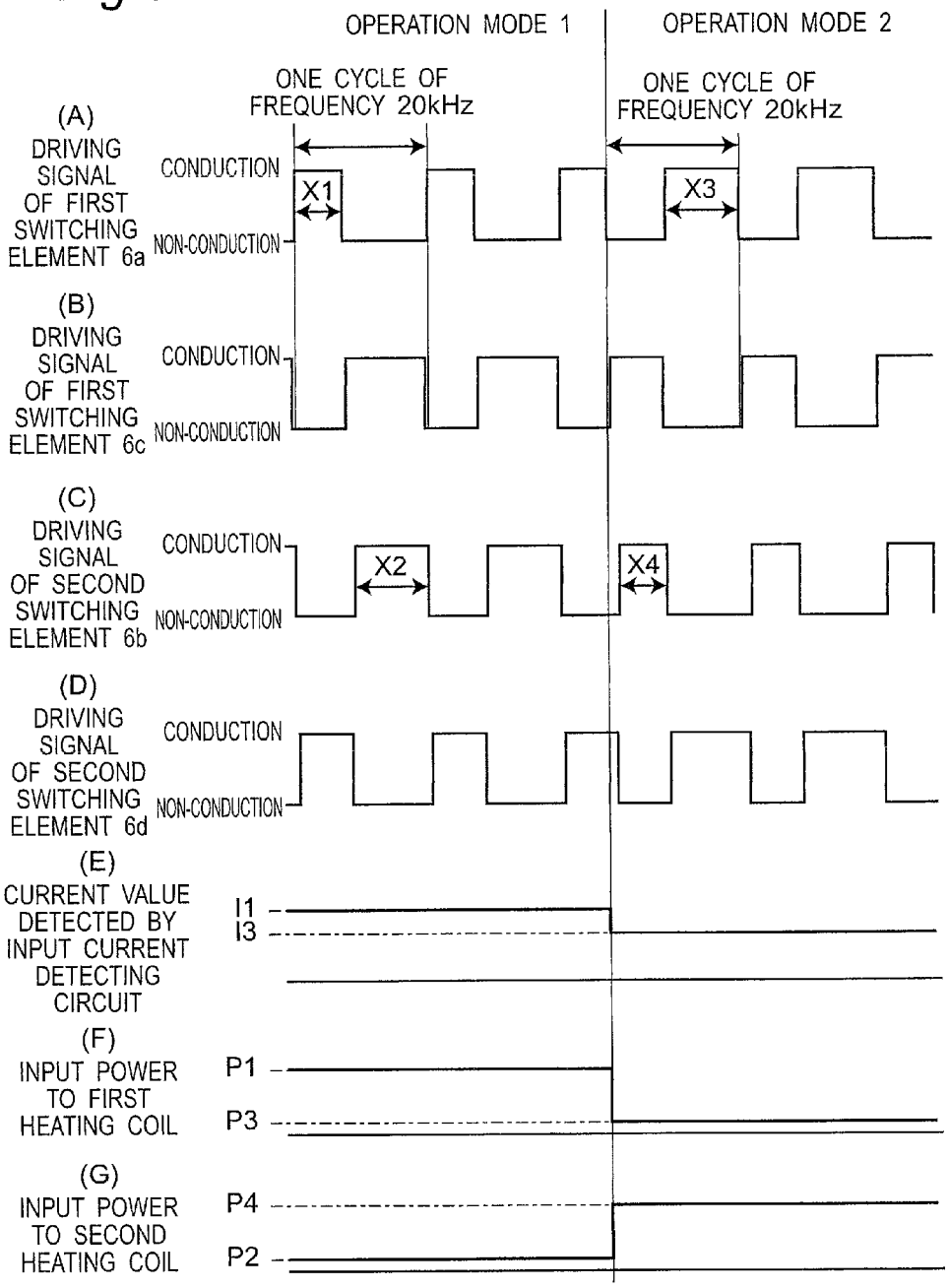
FIG. 6(A)-6(G) are charts of actuating signals of inverters which are alternately heating in the induction heating cooker according to the second embodiment of the present invention.
Figure 7:
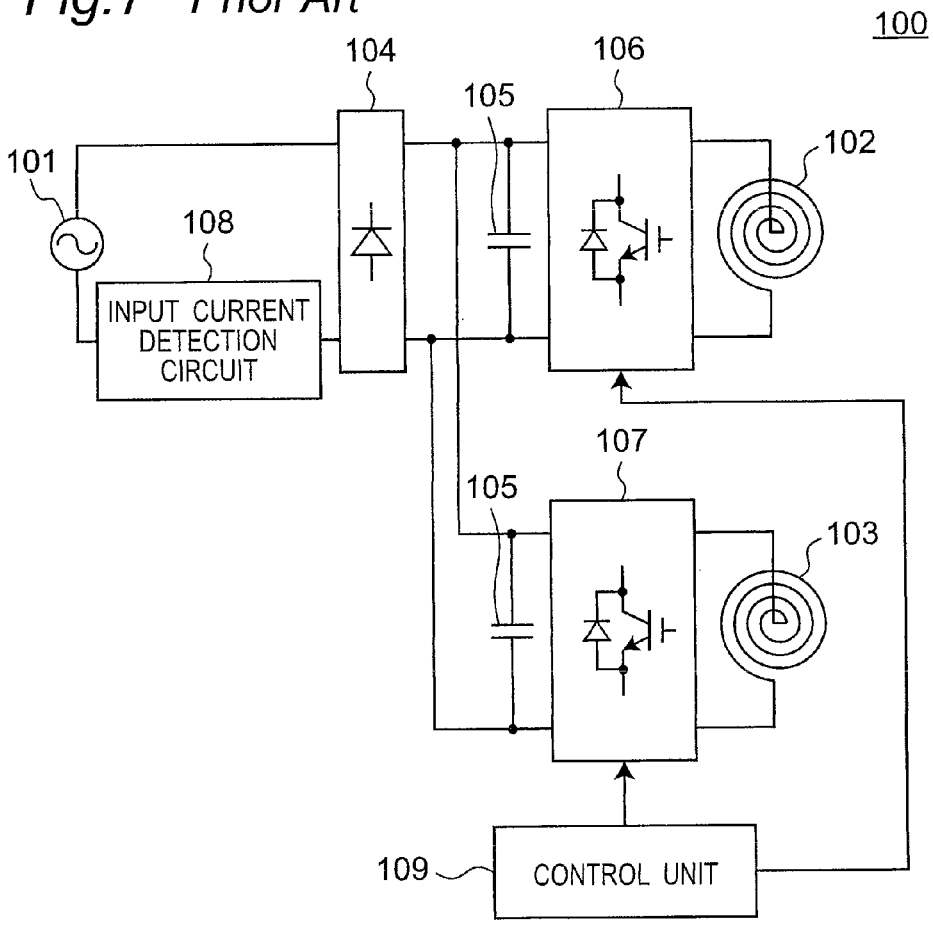
Fig.7 Prior Art
FIG. 7 is a diagram illustrating circuitry of a conventional induction heating cooker.
Figure 8:
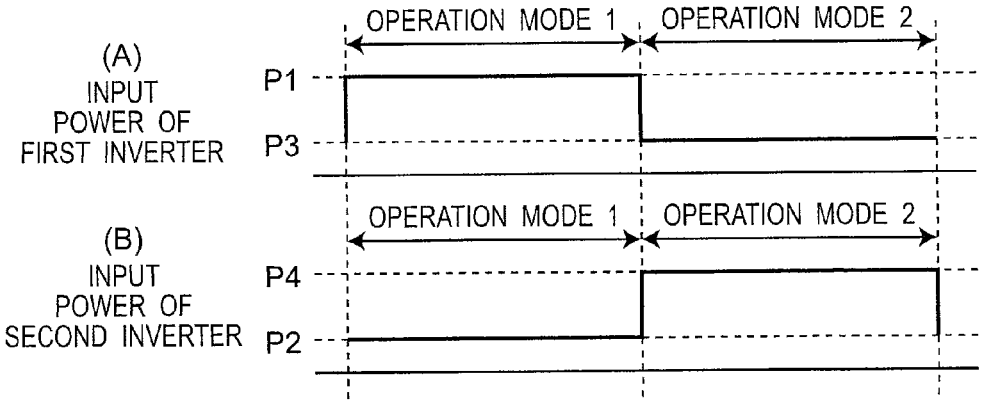
Fig.8 Prior Art
FIG. 8 is a chart of actuating signals of inverters in the conventional induction heating cooker.

FIG. 6 is a chart of actuating signals of inverters which are alternately heating in the induction heating cooker 20 according to the second embodiment of the present invention and, particularly, is a diagram showing operation timings of the inverters in the case where the first heating coil 4*a* and the second heating coil 4*b* are operated at the same time.

In FIG. 6, FIG. 6(A) represents a driving signal of the first switching element 6*a*, and FIG. 6(B) represents a driving signal of the first switching element 6*c*, respectively. FIG. 6(C) represents a driving signal of the second switching element 6*b*, and FIG. 6(D) represents a driving signal of the second switching element 6*d*, respectively. FIG. 6(E) represents the current value detected by the input current detecting circuit 8. Further, FIG. 6(F) represents the input power to the first heating coil 4*a*, and FIG. 6(G) represents the input power to the second heating coil 4*b*, respectively.

When the user of the induction heating cooker 20 instructs the cooker 20 via the operation unit 12 such that the first heating coil 4*a* with the input power Pa will realize heating-operation and the second heating coil 4*b* with the input power Pb will realize heating-operation, the control unit 10 controls the first and second oscillation circuits 7*a* and 7*b* to drive the first switching elements 6*a* and 6*c* and the second switching elements 6*b* and 6*d* for the first and second inverters 11*a* and 11*b*, respectively.

That is, under the control of the control unit 10, in the operation mode 1, the first switching elements 6*a* and 6*c* operate at the conduction ratio X1 which causes the input power of the first heating coil 4*a* to be P1, and the second switching elements 6*b* and 6*d* operate at the conduction ratio X2 which causes the input power of the second heating coil 4*b* to be P2.

Further, under the control of the control unit 10, in the operation mode 2, the first switching elements 6*a* and 6*c* operate at the conduction ratio X3 which causes the input power of the first heating coil 4*a* to be P3, and the second switching elements 6*b* and 6*d* operate at the conduction ratio X4 which causes the input power of the second heating coil 4*b* to be P4.

It is assumed that the operation mode 1 has an operating time T1 and the operation mode 2 has an operating time T2. On the condition that the operation mode 1 of the operating time T1 and the operation mode 2 of the operating time T2 are alternately repeated, the input power Pa of the first heating coil 4*a* is $$Pa=P1\times T1/(T1+T2)+P3\times T2/(T1+T2).$$

The input power Pb of the second heating coil 4*b* is $$Pb=P2\times T1/(T1+T2)+P4\times T2/(T1+T2).$$

For example, the input powers such as Pa=800 W, Pb=500 W, T1=10 ms, and T2=10 ms are realized by a combination of P1=1200 W, P2=400 W, P3=400 W, and P4=600 W.

Usually, the control unit 10 operates the first and second oscillation circuits 7*a* and 7*b* to cause the input current to be a predetermined value by changing the operating frequency. That is, in the operation mode 1, usually the control unit 10 controls to cause the input current to be I1 and the input power to be P1 for the first heating coil 4*a* by changing the operating frequency. Also for the second heating coil 4*b*, usually the control unit 10 controls to cause the input current to be I2 and the input power to be P2 by changing the operating frequency.

However, the input current detecting circuit 8 is for detecting the sum of the currents input to the respective coils, and cannot detect the input current to the individual coil. Then, the induction heating cooker 20 according to the second embodiment fixes the conduction ratio of the second heating coil 4*b*, which has the lower input power, to X2 and assumes the input current to be I2. For the first heating coil 4*a*, the control unit 10 changes the conduction ratio by the feedback control via the second oscillation circuit 7*b* to cause the current detected by the input current detecting circuit 8 to be (I1+I2).

In that case, the input power to the second heating coil 4*b* is deviated from a desired input power since the feedback control is not performed for that input power, but the input power is so small that the deviation is negligible. Since the input power value is big for the input power to the first heating coil 4*a*, the control unit 10 performs the feedback control on the input current to correctly obtain the desired input power P1.

In the operation mode 2, usually the control unit 10 controls to cause the input current to be I3 and the input power to be P3 for the first heating coil 4*a* by changing the operating frequency. Also for the second heating coil 4*b*, usually the control unit 10 controls to cause the input current to be I4 and the input power to be P4 by changing the operating frequency. However, due to the above described reason, the induction heating cooker 20 according to the second embodiment does not perform such control.

That is, in the operation mode 2, the induction heating cooker 20 according to the second embodiment fixes the conduction ratio of the first heating coil 4*a*, which has the lower input power, to X3 and assumes the input current to be I3. For the second heating coil 4*b*, the control unit 10 changes the conduction ratio by the feedback control via the first oscillation circuit 7*a* to cause the current detected by the input current detecting circuit 8 to be (I3+I4). In that case, the input power to the first heating coil 4*a* is deviated from a desired input power since the feedback control is not performed for that input power, but the input power is so small that the deviation is negligible. Since the input power value is big for the input power to the second heating coil 4*b*, the control unit 10 performs the feedback control on the input current to correctly obtain the desired input power P4.

(2.1. Summarization)

As described above, the induction heating cooker 20 according to the second embodiment heats the pot by repeating the operation mode 1 and the operation mode 2 in the alternating operation of the first heating coil 4*a* and the second heating coil 4*b* to obtain the desired input powers for the respective coils by the feedback control on the input currents. Even with only one input current detecting circuit 8, the induction heating cooker 20 according to the second embodiment, which performs the heating operation by alternating a plurality of heating coils, can control the input power to each of the coils. As a result, the manufacturing cost can be reduced for the input current detecting circuit 8.

Other Embodiments

The present invention is not limited to the above described embodiments, and may be subjected to various changes or expansion. For example, several values have been indicated as the operating frequency and the target value of the input power, but these values are not limited to the values described in the embodiments.

INDUSTRIAL APPLICABILITY

As described above, in the induction heating cooker according to the present invention, when a plurality of inverters which are the sources for induction heating are operated at the same time, the input power can be correctly controlled even by no more than one input current detecting circuit. The principle can be applied not only to a cooker but also generally to appliances which have the sources for induction heating.

The invention claimed is:

1. An induction heating cooker comprising:

a rectifier circuit which rectifies an AC power supply;

an input current detecting circuit which detects a current flowing from the AC power supply to the rectifier circuit;

a smoothing capacitor which smooths an output from the rectifier circuit;

a first heating coil;

a second heating coil;

a first inverter which converts an output from the smoothing capacitor into a predetermined frequency by using a semiconductor switch to supply a high-frequency power to the first heating coil;

a second inverter which converts the output from the smoothing capacitor into a predetermined frequency by using a semiconductor switch to supply a high-frequency power to the second heating coil; and a control unit which controls operation of the semiconductor switch to cause the current detected by the input current detecting circuit to be a previously set current value, wherein in the case where the first and second inverters are operated at the same time, the control unit controls to alternately repeat a first operation mode in which an output power from the first inverter is a first output power and an output power from the second inverter is a second output power which is lower than the first output power and a second operation mode in which an output power from the first inverter is a third output power which is lower than the first output power and an output power from the second inverter is a fourth output power which is higher than the second output power and also higher than the third output power, and in the first operation mode, the control unit maintains an operating frequency of the second inverter constant and controls an operating frequency of the first inverter by controlling a conduction time of the semiconductor switch to cause the current detected by the input current detecting circuit to be the previously set current value, and in the second operation mode, the control unit maintains the operating frequency of the first inverter constant and controls the operating frequency of the second inverter by controlling a conduction time of the semiconductor switch to cause the current detected by the input current detecting circuit to be the previously set current value.

2. An induction heating cooker comprising:

a rectifier circuit which rectifies an AC power supply;

an input current detecting circuit which detects a current flowing from the AC power supply to the rectifier circuit;

a smoothing capacitor which smooths an output from the rectifier circuit;

a first heating coil;

a second heating coil;

a first inverter which converts an output from the smoothing capacitor into a predetermined frequency by using a semiconductor switch to supply a high-frequency power to the first heating coil;

a second inverter which converts the output from the smoothing capacitor into a predetermined frequency by using a semiconductor switch to supply a high-frequency power to the second heating coil; and a control unit which controls operation of the semiconductor switch to cause the current detected by the input current detecting circuit to be a previously set current value, wherein in the case where the first and second inverters are operated at the same time, the control unit controls to alternately repeat a first operation mode in which an output power from the first inverter is a first output power and an output power from the second inverter is a second output power which is lower than the first output power and a second operation mode in which the output power from the first inverter is a third output power which is lower than the first output power and the output power from the second inverter is a fourth output power which is higher than the second output power and also higher than the third output power, and in the first operation mode, the control unit maintains a conduction ratio of the second inverter constant and controls a conduction ratio of the first inverter by controlling a conduction time of the semiconductor switch to cause the current detected by the input current detecting circuit to be the previously set current value, and in the second operation mode, the control unit maintains the conduction ratio of the first inverter constant and controls the conduction ratio of the second inverter by controlling a conduction time of the semiconductor switch to cause the current detected by the input current detecting circuit to be the previously set current value.

* * * * *